US005375433A

United States Patent [19]

Skalet

[11] Patent Number: 5,375,433

[45] Date of Patent: Dec. 27, 1994

[54] INTERCHANGEABLE AND REVERSIBLE PIERCED EAR PROTECTOR KIT

[76] Inventor: Christine Skalet, 4741 E. Palm Canyon Dr., Suite 138, Palm Springs, Calif. 92264

[21] Appl. No.: 141,394

[22] Filed: Oct. 22, 1993

[51] Int. Cl.[5] ..... A44C 7/00
[52] U.S. Cl. ..... 63/12; 63/2
[58] Field of Search ..... 63/12, 14.3, 13, 2

[56] References Cited

U.S. PATENT DOCUMENTS

| | | | |
|---|---|---|---|
| 113,031 | 3/1871 | Edge . | |
| 2,691,846 | 10/1954 | Fruhling | 63/12 |
| 2,713,863 | 7/1955 | Handerson . | |
| 4,067,341 | 6/1978 | Ivey | 63/12 |
| 4,459,829 | 7/1984 | Richard et al. . | |
| 4,501,050 | 2/1985 | Fountoulakis . | |
| 4,761,971 | 8/1988 | Freier . | |
| 4,771,613 | 9/1988 | Grier | 63/12 |
| 4,774,817 | 10/1988 | Beam | 63/12 |
| 4,781,036 | 11/1988 | Erickson | 63/12 |
| 5,018,365 | 5/1991 | Luceno | 63/12 |
| 5,020,388 | 6/1991 | Payne et al. . | |
| 5,076,072 | 12/1991 | Payne . | |
| 5,097,681 | 3/1992 | Steele . | |
| 5,154,068 | 10/1992 | DiDomenico | 63/12 |

FOREIGN PATENT DOCUMENTS

| | | | |
|---|---|---|---|
| 276197 | 7/1988 | European Pat. Off. | 63/12 |
| 8809134 | 12/1988 | European Pat. Off. | 63/12 |
| 2239781A | 4/1986 | United Kingdom . | |
| 2189373A | 1/1990 | United Kingdom . | |

*Primary Examiner*—Flemming Saether
*Attorney, Agent, or Firm*—Blakely, Sokoloff, Taylor & Zafman

[57] ABSTRACT

An interchangeable and reversible pierced ear protector kit that includes a sleeve which can be inserted into an ear lobe, and separates the ear from an earring post that extends through the sleeve and is fastened by a retainer clip. Between the retainer clip and the ear is a disk that provides a relatively large surface area to distribute the weight and balance the earring on the ear lobe. The disk also protects the ear lobe from the retainer clip. The kit contains a plurality of shields that have different diameters which corresponds to different earring sizes. Larger shields are used for relatively large earrings, while the smaller shields are installed for relatively small earrings. The shields each have an aperture that has a diameter that is slightly smaller than the outer diameter of the shank. Along an end of the shank are a pair of slits that allow the outer shank wall to deflect when the shield is assembled to the ear. The sleeve deflection provides a spring force which maintains the shield adjacent to the ear.

14 Claims, 1 Drawing Sheet

INTERCHANGEABLE AND REVERSIBLE PIERCED EAR PROTECTOR KIT

BACKGROUND OF THE INVENTION

1. Field of the Invention

The present invention relates to pierced earrings.

2. Description of Related Art

Earrings typically come with two types of fasteners, clip on or pierced. Pierced earrings include a post that is inserted through the ear lobe and held in place with a spring clip. Pierced earrings provide a more secure attachment to the ear than "clip ons" and are therefore preferred by many wearers.

The posts of pierced earrings are frequently constructed from steel or another similar type of material. Steel post can irritate and even infect the ear lobe of some users. Although using gold post can eliminate the physiological reaction of pierced earrings, gold is relatively expensive and therefore economically impractical for many users.

U.S. Pat. No. 5,154,068 issued to DiDomenico; U.S. Pat. No. 5,018,365 issued to Luceno and U.S. Pat. No. 4,067,341 issued to Ivey all disclose earring assemblies that include a sleeve that is inserted into the lobe of an ear. The post of an earring is inserted through the sleeve and fastened to the ear by a spring clip or other fastening means. The sleeve is typically constructed from gold or another material that will not irritate or infect the ear. Although effective in protecting the ear hole, the prior art devices are limited and do not provide for the concept and technique of versatility. It would therefore be desirable to have a pierced earring assembly that would provide versatile structural support and protection that is commensurate with the size and weight of the earring.

SUMMARY OF THE INVENTION

The present invention is an interchangeable reversible pierced ear protector kit that includes a sleeve which can be inserted into an ear lobe, and separates the ear from an earring post that extends through the sleeve and is fastened by a retainer clip. Between the retainer clip and the ear is a disk that provides a relatively large surface area to distribute the weight and balance the earring on the ear lobe. The disk also protects the ear lobe from the retainer clip. The kit contains a plurality of shields that have different diameters which corresponds to different earring sizes. Larger shields are used for relatively large earrings, while the smaller shields are installed for relatively small earrings. The shields each have an aperture that has a diameter that is slightly smaller than the outer diameter of the shank. Along an end of the shank are a pair of slits that allow the outer shank wall to deflect when the shield is assembled to the ear. The sleeve deflection provides a spring force which maintains the shield adjacent to the ear.

It is therefore an object of the present invention to provide an interchangeable and reversible pierced ear protector kit which contains a number of various size shields to correspond to earrings having different weights.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
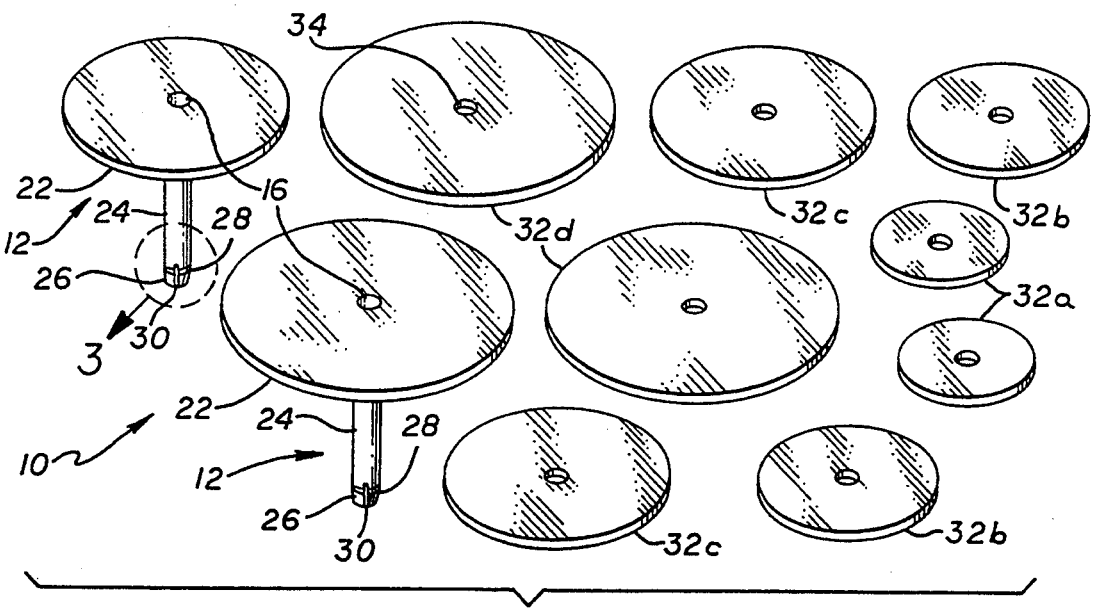
FIG. 1 is a perspective view of an earring kit of the present invention.
Figure 3:
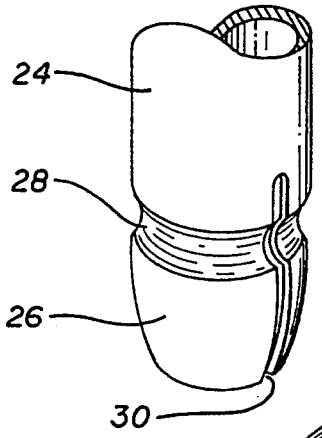
FIG. 3 is an enlarged view of the shank of a sleeve.
Figure 2:
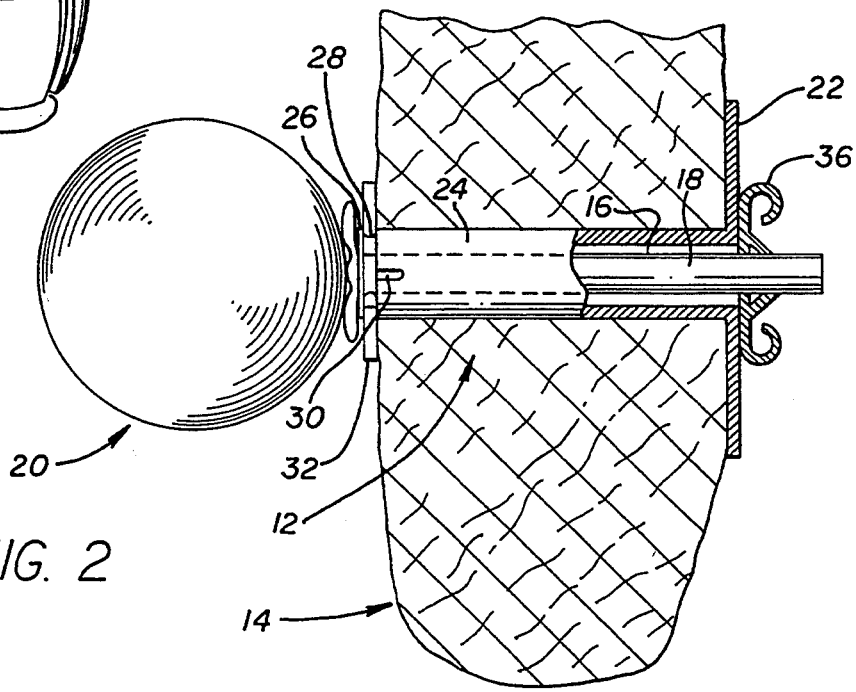
FIG. 2 is a sectional view showing the earring assembly attached to the lobe of an ear.

Referring to the drawings more particularly by reference numbers, FIGS. 1–3 show an earring kit 10 of the present invention. The kit 10 includes a sleeve 12 that can be inserted through an opening in the lobe of an ear 14. The sleeve 12 has a channel 16 that is large enough to allow the post 18 of an earring 20 to be inserted therethrough. The sleeve 12 is preferably constructed from a plastic or gold material which will not irritate or infect the skin of the ear. The sleeve 12 protects the ear from the post 18 which may be constructed from a material that causes discomfort to the user.

The sleeve 12 has a disk 22 that is attached to a shank 24. The disk 22 may be integrally constructed with the shank 24, or soldered thereto. The shank 24 has an annular groove 26 to a tapered end 28 of the sleeve 12. The sleeve 12 also has a slit 30 at the end of the shank 24. Attached to the sleeve 12 is a shield 32. Within the shield 32 is an aperture 34 that has an inner diameter smaller than the outer diameter of the shank 24. The shield 32 is pressed onto the sleeve 12 until it is seated within the annular groove 26. The aperture 34 is typically smaller than the outer diameter of the shank 24 so that the sleeve 12 is radially deflect at the slit 30. The deflection of the sleeve 12 creates a spring force that holds the shield 32 in place. The shield 32 is typically constructed from plastic, gold or some other type of material that will not adversely effect the skin of the ear 14. A spring clip 36 may be attached to the end of the post 18 to secure the earring 20 to the ear 14.

The kit preferably contains 4 pairs of shields 32*a–d* which each have a different diameter. The disk 22 has an outer diameter that protects the ear lobe from the surface of the spring clip 36, which reduces pinching and irritation of the ear and improves the comfort of wearing the earring. In the preferred embodiment, the outer diameter of each shield 32*a–*32*d* is 3/16, ¼, 5/16 and 7/16 inches, respectively. The larger shields 32*c–d* would typically be used with larger earrings, while the smaller shields 32*a–b* would be used with smaller earrings. The sleeve 12 and shields 32 are preferably provided as a set, which has two pairs of sleeves 12 and four pairs of shields. The disks 22 of each sleeve pair may have different sizes. In the preferred embodiment, one set of sleeves has a disk 22 diameter of 5/16 inches, which is typically used for protection against any size spring clip, while the other sleeve set has a disk diameter of 7/16 inches which can protect the ear lobe along with balancing and distributing the weight of the earring. The shields 32 can also be provided separately as an auxiliary set, so that the user can replace any shields 32 that are lost, etc. Although FIG. 2 shows the earring inserted from the back of the ear lobe, it is to be understood that the sleeve 12 can be reversed and inserted from the front of the ear lobe.

To install an earring 20, the sleeve 12 is first inserted into the ear lobe. The shield 32 is than pressed onto the shank 24. The post 18 of the earring is then inserted through the sleeve 12 and may be fastened to the ear by the spring clip 36. If desired, the user may have the sleeve 12 and shield 32 attached to the ear even when the earring is not attached to the ear lobe. If a new earring is later worn, a different shield 32 can be snapped onto the shank 24. For example, the user may first wear a stud earring and thus assemble the smaller shield 32*a* to the ear. The user may then put on a larger earring. To protect the ear lobe from the backside of the earring, the smaller shield 32*a* may be removed and a larger shield 32*b–d* may be installed. What is thus provided is an interchangeable and reversible pierced ear protector kit that can structurally support and protect the ear lobe from a variety of different earrings.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. An interchangeable and reversible pierced ear protector kit for an earring which has a post that is inserted into an ear and held in place by a spring clip, comprising:

a first sleeve and a second sleeve that each have a disk and a shank that are adapted be inserted into the ear, each said sleeve having a channel that can receive the post of the earring, said disk of said first sleeve having a diameter that is larger than a diameter of said disk of said second sleeve;

a first flat disk shaped shield that can be attached to said shank of said sleeve, said first shield having a first diameter; and, a second flat disk shaped shield that can be attached to said shank of said sleeve, said second shield having a second diameter that is larger than said first diameter.

2. The kit as recited in claim 1, wherein said sleeve is constructed from gold.

3. The kit as recited in claim 1, wherein said first and second shields are constructed from gold.

4. The kit as recited in claim 1, wherein said sleeve is constructed from plastic.

5. The kit as recited in claim 1, wherein said first and second shields are constructed from plastic.

6. The kit as recited in claim 1, wherein said shank has an annular groove.

7. The kit as recited in claim 1, wherein said sleeve has a slit in said shank.

8. The kit as recited in claim 1, further comprising a third shield which has a third diameter larger than said second diameter of said second shield, and a fourth shield which has a fourth diameter larger than said third diameter of said third shield.

9. An interchangeable and reversible pierced ear protector kit for an earring which has a post that is inserted into an ear and held in place by a spring clip, comprising:

a first sleeve and a second sleeve that each have a disk and a shank that are adapted to be inserted into the ear, each said sleeve having a channel that can receive the post of the earring, said shank having a slit and an annular groove, said disk of said first sleeve having a diameter that is larger than a diameter of said disk of said second sleeve;

a first flat disk shaped shield that can be seated within said annular groove of said shank, said first shield having a first diameter; and, a second flat disk shaped shield that can be seated within said annular groove of said shank, said second shield having a second diameter that is larger than said first diameter.

10. The kit as recited in claim 9, wherein said sleeve is constructed from gold.

11. The kit as recited in claim 9, wherein said first and second shields are constructed from gold.

12. The kit as recited in claim 9, wherein said sleeve is constructed from plastic.

13. The kit as recited in claim 9, wherein said first and second shields are constructed from plastic.

14. The kit as recited in claim 9, further comprising a third shield which has a third diameter larger than said second diameter of said second shield, and a fourth shield which has a fourth diameter larger than said third diameter of said third shield.

* * * * *

UNITED STATES PATENT AND TRADEMARK OFFICE

CERTIFICATE OF CORRECTION

PATENT NO. : 5,375,433

DATED : December 27, 1994

INVENTOR(S) : Skalet

It is certified that error appears in the above-identified patent and that said Letters Patent is hereby corrected as shown below:

In claim 1 in column 3 at line 28 change "are adapted be" to --are adapted to be--.

Signed and Sealed this

Twenty-second Day of August, 1995

Bruce Lehman

*Attest:*

BRUCE LEHMAN

*Attesting Officer*

*Commissioner of Patents and Trademarks*